US005170982A

United States Patent [19]

Schultheis et al.

[11] Patent Number: 5,170,982

[45] Date of Patent: Dec. 15, 1992

[54] GRAVITY ACTIVATED HOLDER FOR SHEET MATERIAL

[76] Inventors: Gerald A. Schultheis; Debra A. Schultheis, both of E. 1907 Longfellow, Spokane, Wash. 99207

[21] Appl. No.: 807,047

[22] Filed: Dec. 12, 1991

[51] Int. Cl.[5] ..... A47G 1/10

[52] U.S. Cl. ..... 248/316.3; 211/89

[58] Field of Search ..... 248/316.3, 316.1, 110; 211/89, 66; 24/488

[56] References Cited

U.S. PATENT DOCUMENTS

| | | | |
|---|---|---|---|
| 1,221,279 | 4/1917 | Brisley | 248/316.3 |
| 1,235,600 | 8/1917 | Reimer | 248/316.3 |
| 1,364,190 | 1/1921 | Erickson | 211/89 X |
| 1,944,304 | 2/1934 | Scarnegie . | |
| 2,377,488 | 6/1945 | Fugazzi | 248/316.3 X |
| 2,521,604 | 9/1950 | Provost . | |
| 2,912,117 | 11/1959 | Clay | 211/89 |
| 3,159,281 | 12/1964 | Hutter et al. . | |
| 3,168,954 | 2/1965 | Von Herrmann . | |
| 3,294,350 | 12/1966 | Grottola et al. . | |
| 3,591,013 | 7/1971 | Von Herrmann . | |
| 4,039,134 | 8/1977 | Redmer | 248/316.3 X |
| 4,085,848 | 4/1978 | Tsuge | 211/89 X |

FOREIGN PATENT DOCUMENTS

| | | | |
|---|---|---|---|
| 317717 | 1/1920 | Fed. Rep. of Germany | 248/316.3 |
| 250612 | 5/1919 | France . | |
| 2451491 | 11/1980 | France | 248/316.3 |
| 266473 | 3/1932 | Italy . | |
| 399773 | 11/1942 | Italy | 248/316.3 |
| 1012541 | 3/1944 | United Kingdom . | |
| 1142211 | 11/1945 | United Kingdom . | |

*Primary Examiner*—J. Franklin Foss

[57] ABSTRACT

A holder for sheet-like material provides a base defining a vertically oriented channel carrying a dense sphere to contact a spacedly adjacent holding arm to hold sheet-like material between the ball and the holding arm. The channel carrying the ball has a curvilinear surface most distal from the holding arm to move the ball closer to the fastening arm as the ball moves downwardly in the channel. The ball is of such size that it is prevented from passing from the lower end of the channel by the holding arm. Sheet material moved in an upward direction between the ball and fastening arm is held from moving downwardly by reason of frictional contact with the ball and holding arm, but may be removed from the holder by moving the material in an upwardly angulated direction which releases the holding friction.

1 Claim, 1 Drawing Sheet

GRAVITY ACTIVATED HOLDER FOR SHEET MATERIAL

II. BACKGROUND OF INVENTION

IIA. RELATED APPLICATIONS

There are no applications related hereto heretofore filed in this or any foreign country.

IIB. FIELD OF INVENTION

This invention relates generally to holders for sheet material, and more particularly to such a holder that has a gravity activated ball movable in a channel angulated to a vertical holding surface to hold material between the ball and the holding surface.

IIC. DESCRIPTION OF PRIOR ART

Various devices to hold a depending sheet-type object between a rigid vertically oriented surface adjacent a movable gravity biased, curvilinear element have heretofore become known, and though such devices have developed with substantial sophistication especially for particular purposes, they still have not resolved all of the problems that arise with use of such holding devices. My invention provides a new and novel holder of this type that resolves problems not addressed by known holders.

Such holders for sheet material that provide a vertical element for motion in a downwardly tapering wedge-shaped channel are generally desirable because they allow one-handed operation in either fastening or releasing an object in the same fashion as hook-type fasteners, but yet with more secure holding than is provided by a hook-type fastener. To accomplish this end, such devices must generally have a movable fastening element that has a curvilinear surface, at least in a vertical plane, and by reason of this requirement fasteners of both cylindrical rod and spherical shape have become known. My invention is concerned with holders having spherical ball fastening elements and is thereby distinguished from holders using cylinders of one type or another as fasteners. The device using cylindrical fasteners generally may be used only with sheet material that may be lifted in an angulated fashion to cause a fastening cylinder to release the material from its fastened mode. In general such cylinder fastening devices will not allow removal of fastened material merely by motion in a laterally and upwardly directed fashion as will many ball fastening devices, and therefore may not be operated with only one hand.

The rod fastening holder requires sufficient semi-rigidity in sheet-like material to allow that material to move a rod upwardly in its fastening channel to cause release of the sheet material, and this generally prevents use of such devices with cloth or similar materials which do not have sufficient rigidity to be configurationally sustaining. In general in rod fastening holders if cloth be held and release attempted, the cloth will merely tend to enhance the holding friction between the fastening rod and the adjacent holding surface to prevent material release and possibly cause tearing or other physical damage to material being held.

One class of ball fastening devices that provides little more utility than the cylinder fastening type provides a vertically oriented channel through which the fastening ball may be manually accessed so that it may be manually moved from a fastening position. This type of fastener oftentimes provides a particular structure that would prevent release of fastened sheet material in any other fashion, and in any event requires the use of a first hand to manipulate the fastened sheet material and a second hand to manipulate the fastening ball so as to do away with the one-handed operation of the holding device. My invention is contradistinction allows one-handed placement of an object by moving it upwardly through a the holding slot and one-handed release of a fastened object by moving it somewhat upwardly and laterally from that slot.

Another class of such fastening devices using ball type fasteners do not maintain the ball in a rigid, vertically oriented channel to allow release of a held element. One group of this class provides a movable element defining a portion of the channel, commonly that against which a held object is frictionally engaged, that may move outwardly away from a ball to allow object release. This provides a rather erratic type of release that is more dependent on the frictional nature of the surfaces involved and one that may in fact more strongly fasten an object held than cause its release when it is moved in a laterally upward direction to accomplish release. Additionally such devices commonly will move sufficiently to allow the ball fastener to move from the fastening channel so that it may be lost and it may be reinstalled oftentimes only with substantial difficulty. Another group of this class of devices provides wedge-shaped fastening structure that constitutes all or a segment of a circular disk so that a fastening ball may move a direction other than vertical. With such devices, an object being held may be released by moving it laterally and upwardly, but the release is problematic as the wedge shape is about as effective for fastening in other than a vertical direction as it is in the vertical direction when an object is moved for release. The release process may even cause tighter fastening and may result in tearing or damage to an object and in any event, results in difficult and erratic object removal.

The nature and shape of the surfaces forming the wedge channel in which a ball is carried are critical to the operation of ball type holders. Commonly such channels have one substantially planar vertical surface against which a sheet object is held by a ball, and this surface must have appropriate frictional characteristics to allow holding by a ball of particular size and density while not creating such great forces that the held element may not be released without damage by moving it in an upward and lateral direction. Commonly prior holders have provided metal or plastic holding surfaces. We have found the friction of such surfaces to be too low to provide adequate holding, and we therefore have used a natural planed wooden surface for such purposes which distinguishes our holder from others previously known.

Additionally, the configurational nature of the channel surface opposite the vertical holding surface is quite critical in that it should allow a substantial horizontal motion for a ball responsive to its vertical motion, but yet the lateral force on the ball should be substantially uniform along its entire vertical course and the angle of the wedge surface relative to the holding surface should not be greater than about fifteen to twenty degrees. We have found a circular arcuate surface having a diameter approximately seven to ten times that of a spherical holding ball creates appropriate forces for holding of most sheet-like objects in such holders. Prior holders have used either linear angulated surfaces or curvilinear surfaces of some nature other than circular, and they are distinguishable from our invention in this regard.

Many prior devices have used curves with increasing curvature in their lower portions, and in some cases have gone to extremes wherein the holding ball is actually prevented from further downward motion by the wedge surface alone at or substantially at the point at which it holds sheet material. These devices in general do not provide secure holding, are not readily adjustable for use with sheet materials of various thicknesses and flexibilities, do not well hold a sheet of material once in holding position, and do not well release that material.

Ball-type holding devices commonly are mounted on some support structure for use and most generally the devices are mounted on a vertical structural wall. Most if not all such prior devices have provided a frictional holding surface on the inner surface of the holder that is proximal to the support surface. This maintains an object that is held in close proximity with the supporting structure so that it may be difficult to grasp and its contact with the structure may cause damage, either to the object being held or the supporting structure. Our invention resolves this problem by providing the frictional holding surface on the wedge surface most distal from a supporting surface, so that an object held in my holder is spacedly adjacent the supporting surface to alleviate such problems.

Our invention resides not in any one of these features per se, but rather in the synergistic combination of all its structural elements that necessarily give rise to the functions flowing therefrom as herein specified and claimed.

II. SUMMARY OF INVENTION

My invention provides a flat body having adhesive means for attachment to a supporting surface and defining in the body face a medial, vertically extending groove with an arcuate inner surface. A support arm structurally supported by the body depends spacedly adjacent at least the lower portion of the groove defined in the body. A fastening ball is carried in the vertical groove. The space between the depending support arm and the body and the diameter of the fastening ball are such that the ball is prevented from moving out of the groove. The surface of the groove distal from the support arm is arcuate and substantially seven to ten times the diameter of a holding ball. The holding ball is formed of smooth steel and the depending fastening arm of smooth hard wood to obtain proper frictional contact to hold sheet-like material therebetween.

In creating such a holder it is:

A principal object to provide a device for releasable holding of sheet-like material for varying thickness and rigidity.

A further object is to provide such a holder that allows placement and removal of sheet material by one-handed manipulation moving the material in an upward direction for placement and in an upwardly angulated lateral direction for removal.

A further object is to provide such a holder that securely holds sheet material against downwardly directed forces and increases its holding friction in proportion to such downwardly directed forces.

A still further object is to provide such a holder that is formed of particular materials with particular configurations to maximize frictional forces holding materials within the device.

A still further object is to provide such a holder wherein the held material is at a maximum distance from a surface supporting the holder.

It is a still further object of my invention to provide such a holder that is of new and novel design, of rugged and durable nature, of simple and economic manufacture and one otherwise well adapted to the uses and purposes for which it is intended.

Other and further objects of our invention will appear from the following specification and accompanying drawings which form a part hereof. In carrying out the objects of our invention, however, it is to be remembered that its accidental features are susceptible of change in design and structural arrangement with only one preferred and practical embodiment of the best known mode of operation being illustrated and specified as required.

IV. BRIEF DESCRIPTION OF DRAWINGS

In the accompanying drawings which form a part hereof and wherein like numbers of reference refer to similar parts throughout:

V. DESCRIPTION OF PREFERRED EMBODIMENT

Figure 1:
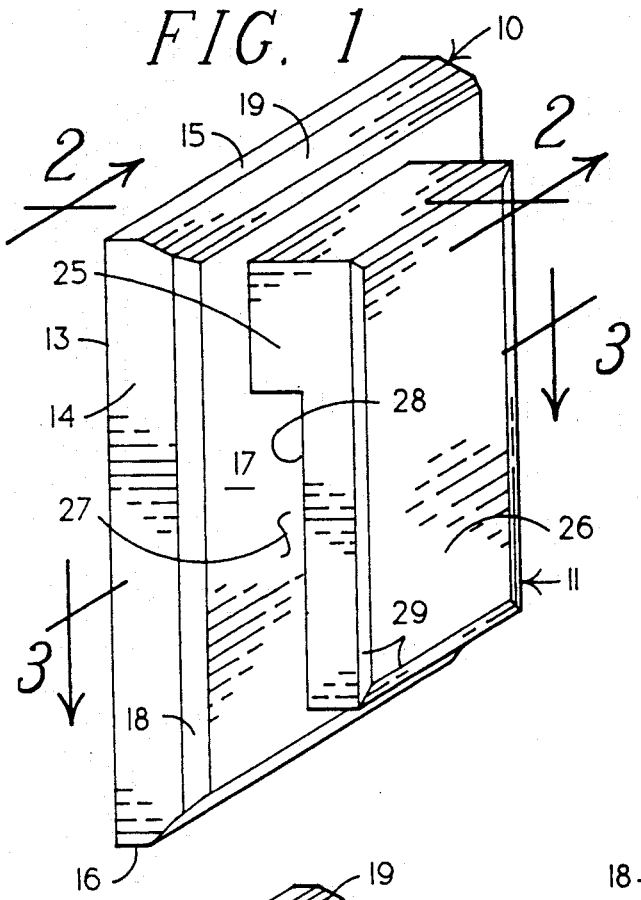
FIG. 1 is an isometric surface view of my holder showing various of its parts, their configuration and relationship.
Figure 2:
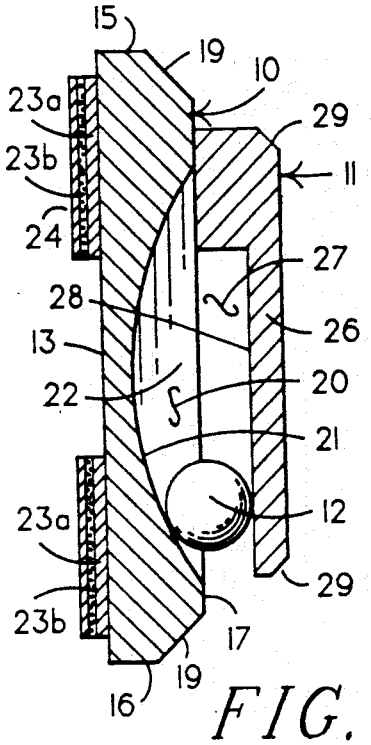
FIG. 2 is a vertical medial cross-sectional view of the holder of FIG. 1, taken on the line 2—2 thereon in the direction indicated by the arrows.
Figure 3:
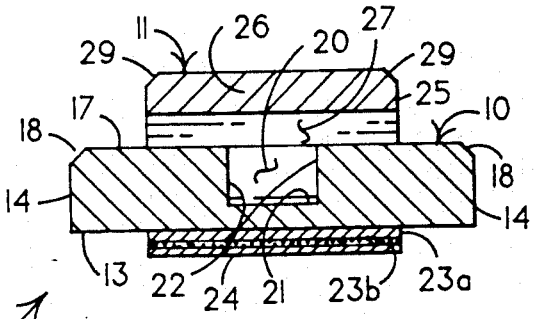
FIG. 3 is a medial horizontal cross-sectional view of the holder of FIG. 1, taken on the line 3—3 thereon in the direction indicated by the arrows.
Figure 5:
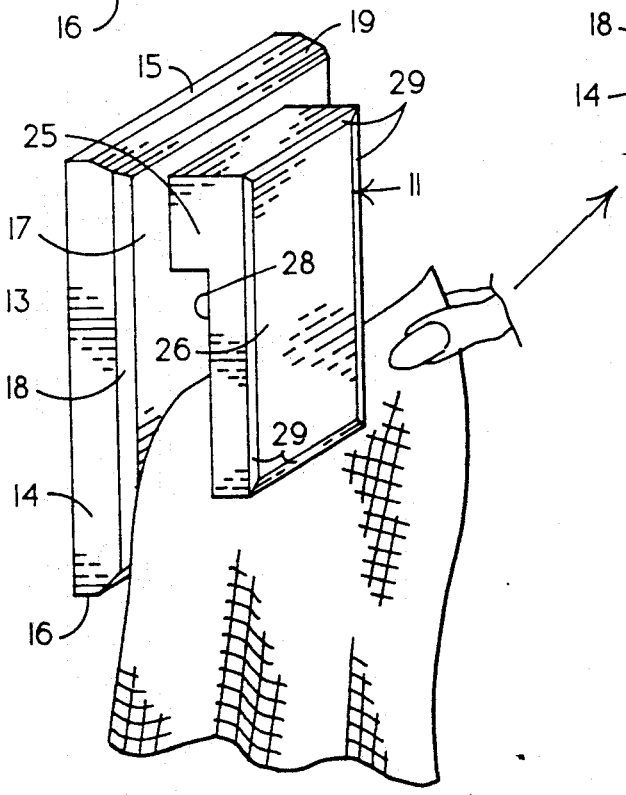
FIG. 5 is a somewhat diagrammatic isometric illustration showing placement or removal of a piece of cloth from the device.
Figure 4:
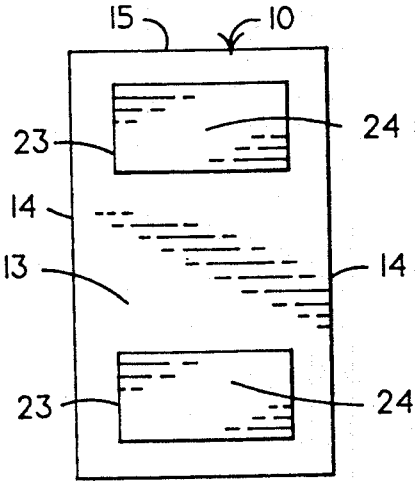
FIG. 4 is an orthographic elevational view of the back of the holder of FIG. 1, somewhat reduced in size.

My invention generally provides base 10 defining a vertical channel carrying a fastening ball 12 which is maintained in the channel by the spacedly adjacent depending arm of fastening structure 11 supported on the base.

Base 10 comprises a rectilinear box structure defined by back 13, similar vertical sides 14, top 15, bottom 16, face 17. The vertical side edges of the face 17 are relieved by smaller chamfers 18 and the top and bottom horizontal edges of the face are relieved by somewhat larger chamfers 19. The base has some substantial thickness, that is the vertical dimension between its back 13 and face 17, to allow definition of a fastening ball groove therein.

Fastening ball groove 20 is defined in the medial portion of face 17 of the base by rearward curvilinear wall 21 and similar planar parallel side walls 22 which are perpendicular to ruling elements forming the rearward surface 21. The distance between side walls 22 is slightly greater than the diameter of a fastening ball to be carried within the groove so that the ball may move freely in a vertical direction in that groove, but yet be restrained from any substantial horizontal displacement. The nature of the arcuate configuration of rearward wall 21 is somewhat critical to my invention. This configuration preferably and in the instance illustrated takes the form of a portion of the surface of a circular cylinder having a diameter of approximately seven to ten times the diameter of a fastening ball to be carried therein. The configuration of this rearward wall 21 must be such as to allow a substantial portion of a fastening ball to be contained in the fastening ball groove when the ball is in an upward position to allow the fastening of thicker sheet material in my holder. The configuration of the rearward wall in its lower portion must also be such as to prevent a fastening ball, constrained from outward motion by an adjacent fastening arm, from moving out of the lower portion of the fastening groove, and the curvature of the rearward wall in its lower portion preferably should decrease in a downward direction to provide appropriately secure holding of relatively thin or smooth surfaced sheet material. The circular surface preferred and illustrated fits these conditions, though other surfaces possessing the appropriate qualifications are within the scope of our invention.

Back 13 of the base carries one or more fasteners 23 to attach the base to a supporting surface. The fasteners in the instance illustrated are two in number and of an adhesive nature. Each fastener provides a base 23*a* coated on its rearward facing surface with adhesive 23*b* and covered by removable protective covering 24. The base 23*a* of each fastener is structurally maintained on back 13 by some mechanical fastening means (not shown), in the case illustrated an adhesive (not shown). The adhesive 23*b* is of a pressure sensitive type that will adhere to smoother, harder surfaces upon application thereto after removal of protective covering 24. Such adhesive fasteners are readily available in the present day marketplace, constitute no essential part of my invention but only an accidental feature to make it operative, and therefore are not described in detail.

Fastening arm structure 11 provides upper body 25 structurally carrying depending fastening arm 26, with its rearward surface spacedly adjacent face 17 of the base to define fastening channel 27 therebetween. The configuration of the fastening arm structure preferably is such that the body and fastening arm are substantially the same width which should be at least as great as the width of fastening ball groove 20 and preferably somewhat greater but less than the width of base 10. The lowermost portion of fastening arm 26 should not extend below the point of maximum depth of the fastening ball groove and preferably should terminate spacedly thereabove to allow the fastening of material of maximum thickness in our holder. The depending fastening arm 26 should have a downward extension substantially as great as the downward extension of the adjacent fastening ball groove. The depth of fastening channel 27, that is the distance from the face 17 of the base to the rearward surface 28 of the fastening arm, must be less than the diameter of a fastening ball to be carried in the fastening ball groove 20 and preferably is about seventy-five percent of that diameter. Normally the forward or face surface of the fastening arm structure will have its edges relieved by chamfers 29 for convenience and utility, though this requirement obviously is not of essence to our invention.

The materials from which my invention is formed, though not critical to its essence do materially effect the operability of the holder. The frictional nature of rearward surface 28 of the fastening arm is material as it contacts one surface of sheet material to be held and determines a substantial portion of the frictional forces generated by our holder upon that material. I have found a smooth planed wood surface, either in non-finished state or with a finish that does not materially effect the natural wood surface character to be preferable. The wood of preference is a reasonably fine grained white oak, though other materials including other arboreal products are within the scope of my invention. Plastic materials may be used and are within the scope of our invention. If such materials in their ordinary formed state present too smooth a surface, that surface may be impressed with a patternation to provide higher frictional characteristics, such as by embossing, brush finishing or the like. The other portions of the base and fastening arm structure of our holder are not particularly critical so long as the material from which they are formed provides sufficient strength, rigidity and durability to fulfill its purpose.

The nature of fastening ball 12 also is material to the operation of our holder, though again not critically essential to such operation. We prefer to use a spherical metallic ball preferably formed of steel, such as an ordinary steel ball bearing. The primary characteristics sought to be attained with such a ball is the density of the material, as the overall size of the fastening ball is somewhat limited by geometrical constraints on the holder while its overall weight or mass is the principal factor in determining the force between adjacent surfaces of material to be held and the depending fastening arm. The frictional nature of the surface of the fastening ball is not critical in determining the ultimate holding power of the device, since the ball is freely movable in any direction by reason of rotation, and even when a higher friction surface the ball would tend to move rather than frictionally hold material in contact therewith. Balls of lower density, such as those formed from plastic, wood or similar substances, are within the scope and ambit of our invention, though they are not as functionally efficient as balls formed of higher density materials.

Fastening ball 12 is a spherical element formed of some harder, rigid substance such as steel. The size of the fastening ball is not essentially critical and may vary within limits, though the size must be regulated to the size and configuration of the fastening ball channel and the spacing of the depending fastening arm from the face of the base as herein indicated. Commonly for the fastening of ordinary objects ranging through thicker and thinner plastics through sheet-type fabrics to paper the diameter of fastening ball 12 is approximately five-eighths of an inch (1.59 cm) and formed from steel or material of similar density and somewhat greater with less dense materials ranging up to an inch or more with various plastics.

Having thusly described our invention its use and function may be understood.

Firstly, a holder is formed according to the foregoing specification and as illustrated in the accompanying drawings. The base of the holder is mounted on a supporting structure in a substantially vertical orientation, by use of fasteners 23. The device may be fastened by any other known mechanical means that positionally maintain it and those fastening means are within the scope of our invention.

Once mounted, our holder is used by manually moving a piece of sheet material upwardly within fastening channel 27 and between fastening ball 12 and rearward surface 28 of fastening arm 26. Once such material is moved into the holder as indicated, it will be supported against downward displacement as the fastening ball will be biased downwardly by gravity to create a frictional contact of the sheet material on the side against the depending fastening arm. To remove an article being held in our holder, the material is removed in an upward and lateral direction until it is removed from contact between the fastening ball and the fastening arm. The upward component of this motion need not be great, so long as it is angulated above the horizontal.

It is to be particularly noted that when material is fastened in our holder any forces that are angulated downwardly from the horizontal will tend to increase the frictional engagement of the sheet material between the fastening ball and adjacent fastening arm, since those forces will tend to rotate the ball in a clockwise direction which tends to move it downwardly to increase pressure between the sheet material and the fastening arm to thusly increase the holding friction. The more vertically downward this force is oriented the greater will be its effect on holding power.

Similarly it is to be noted that with any forces on sheet material being held that are oriented upwardly, those forces will tend to rotate the fastening ball in a counter-clockwise direction which will tend to lessen the force generated by the ball against the fastening arm and thusly lessen the overall friction, while at the same time the ball will be free to rotate in a lateral direction to further aid the passage of a previously fastened object from the fastening channel. In either fastening or releasing of objects, the configurations involved generate mechanical results that tend to enhance the action being undertaken. These actions are not practically independent of the materials involved and for practical holding functions the parameters specified are reasonably required.

It is further to be noted from the structure specified that there is no particular theoretical limit to the thickness of material that might be held in our holder nor generally to the size of such materials, but again there are practical limits. Our holder is designed primarily for paper-like, fabric and sheet materials such as towels, generally of a thickness of not more than approximately three-eighths of an inch (0.95 cm).

The foregoing description of our invention is necessarily of a detailed nature so that a specific embodiment of might be set forth as required, but it is to be understood that various modifications of detail, rearrangement and multiplication of parts might be resorted to without departing from its spirit, essence, or scope.

Having thusly described our invention, what we desire to protect by Letters Patent, and

What we claim is:

1. A gravity biased, ball-type holder for sheet material, comprising in combination:

a rigid base having a back carrying fastening means for attachment to a substantially vertically oriented supporting surface and a face defining a vertically orientated fastening ball groove with similar vertical sides and inner surface comprising a portion of a circular cylinder having a substantially horizontal axis and a diameter of between seven and eleven times the diameter of a fastening ball, said fastening groove terminating spacedly adjacent the lower portion of the base and configured to receive a fastening ball for motion therein;

a spherical fastening ball, having a smooth surface and density substantially the same as steel, movably carried within the fastening ball groove; and fastening structure having an upper body carried by the face of the base with a fastening arm depending from the upper body spacedly adjacent and parallel to the face of the base and over the fastening groove, said fastening arm being spaced from the face of the base a distance of less than the diameter of the fastening ball but great enough that the fastening ball may freely move in the medial portion of the fastening groove with sheet material to be fastened in the holder between the fastening ball and the fastening arm, and the body facing surface of the fastening arm having a planar configuration substantially parallel to the face of the base and formed of material having frictional characteristics substantially the same as planed wooden surface.

* * * * *